US005362924A

United States Patent [19]

Correnti

[11] Patent Number: 5,362,924

[45] Date of Patent: Nov. 8, 1994

[54] PROTECTIVE COVER FOR ELECTRICAL WALL SOCKETS

[76] Inventor: Giuseppe A. Correnti, 4 River St., Apt. 33, Little Ferry, N.J. 07643

[21] Appl. No.: 58,403

[22] Filed: Jun. 23, 1993

Related U.S. Application Data

[63] Continuation-in-part of Ser. No. 885,379, May 19, 1992, abandoned.

[51] Int. Cl.[5] ..... H01R 13/447

[52] U.S. Cl. ..... 174/67

[58] Field of Search ..... 174/67; 220/242; 439/136, 142, 147

[56] References Cited

U.S. PATENT DOCUMENTS

| | | | |
|---|---|---|---|
| 3,716,815 | 2/1973 | Riches | 174/67 X |
| 3,811,004 | 5/1974 | Moore | 174/67 |
| 4,289,921 | 9/1981 | Gartner et al. | 174/67 X |
| 4,505,403 | 3/1985 | Bowden, Jr. et al. | 174/67 X |
| 4,899,019 | 2/1990 | Riceman | 174/67 |
| 5,218,169 | 6/1993 | Riceman | 174/67 |

*Primary Examiner*—Leo P. Picard
*Assistant Examiner*—D. A. Tone
*Attorney, Agent, or Firm*—Donald R. Heiner

[57] ABSTRACT

An electrical wall plug outlet enclosure and safety device wherein a face plate is detachably mounted to the wall over the electrical wall plug outlet and in turn a generally rectangular shaped cover or box-like structure is hingedly or pivotally attached to and over the face plate to prevent touching of the prongs of an inserted electrical plug and to prevent the insertion of an object, especially a metal object, into the electrical outlet when a plug is not inserted. The face plate has a raised shoulder on all four sides and a flange receiving recess is formed in the shoulder at its lower end. Further, tabs are formed integrally on the inside of each of the two vertical shoulders near the top of the face plate and apertures are formed through the tabs and adjacent shoulders for receiving pins associated with the top of the cover for pivotably mounting the cover to the face plate. The lower end of the cover has a flange which is received in the shoulder recess for further securing the cover to the face plate. A cam surface attached to the face plate, at its upper end and at about its mid-point, cooperates with a flange of the cover for securing the cover in an open position when the cover is rotated upwardly about the pins from its closed position.

5 Claims, 3 Drawing Sheets

PROTECTIVE COVER FOR ELECTRICAL WALL SOCKETS

This application is a continuation in part of patent application Ser. No. 07/885,379 filed May 19, 1992 abandoned.

CROSS REFERENCE TO RELATED APPLICATIONS

Applicant has two co-pending applications; Ser. No. 07/910,522 filed Jul. 8, 1992 Pat. No. 5,195,901 and, Ser. No. 07/906,488 filed Jun. 30, 1992 Pat. No. 5,252,083 both of which are Continuation-In-part applications and which are for the same general subject matter as the instant invention.

BACKGROUND OF INVENTION

1. Field of the Invention

The present invention generally involves the field of technology pertaining to devices for covering an electrical wall outlet receptacle and more specifically, the invention relates to a combination of a face plate detachably mounted to a wall and over the electrical receptacle and a cover or box-like structure hingedly or pivotally attached to the face plate for covering it when an electrical appliance cord is plugged into the receptacle. The face plate comprises a generally rectangular planar surface having a raised shoulder on all four edges generally perpendicular to the planar surface and a flange receiving recess is formed in the shoulder, adjacent to the planar surface at its lower edges, tabs are formed integrally on the inside of each of the two vertical shoulders near the top of the face plate and adjacent to the planar surface. Apertures are formed through each of the two tabs and through the adjacent shoulders for receiving pins associated with the top of the cover or box-like structure for pivotally mounting the cover to the face plate. Vertical slots are formed in each tab extending downwardly from the top of the vertically extending shoulders and intersecting the apertures formed through the tabs whereby the pins of the cover are slidably received and then extended through the apertures. The lower end of the cover or box-like structure has a flange which is received in the recess formed in the bottom shoulder of the face plate for further securing the cover to the face plate. A cam surface is attached to the planar cover, at its upper end, at about its mid-point, which cooperates with a flange formed on the upper surface of the box-like cover for securing the cover in the opened position when it is rotated upwardly to an open position.

Openings are provided in the cover or box-like structure through which electrical cords pass when an electrical appliance is plugged into the electrical outlet and the cover is pressed over the face plate.

Electrical wall outlets present several significant dangers to children and adults alike. Electrical cords tend to become worn or frayed where they enter an electrical plug; an electrical plug may become partially disengaged from an outlet thereby exposing the prongs of the plug; or, if no appliance is plugged into the electrical outlet, there is the danger of someone, especially a child, inserting a metal object into the outlet and receiving a shock.

Therefore, a need exists for a safety device which prevents against these dangers.

Description of the Prior Art

In applicant's co-pending application the Examiner has cited the following references as examples of other devices which provide protection against the inherent dangers of electrical wall outlets; Ruskin U.S. Pat. No. 2,880,264, Hirsch U.S. Pat. No. 2,916,733, Shotey U.S. Pat. No. 4,874,906, Domian U.S. Pat. No. 4,915,638, Gartner et al. U.S. Pat. No. 4,289,921, Leong U.S. Pat. No. 4,381,063 and Bowden, Jr. et al. U.S. Pat. No. 4,505,403.

In the Domian U.S. Pat. No. 4,915,638 a box-like cover is pivotally connected to a base plate or face plate by means of a lip which projects outwardly and generally parallel to the plane of an opening from the edge of the cover and which is received in a horizontal slot in the base plate. This is substantially structurally different from the instant invention wherein pins located near the top of a box-like cover cooperate with openings formed in a shoulder of a base plate to form a hinge or pivot type opening.

The Gartner et al. U.S. Pat. No. 4,289,921 discloses a much more complicated pin and recess means as clearly indicated in the section entitled "Cover 32" in Columns 5 and 6. Further, the Gartner et al. patent does not teach the lower closure member of the instant invention.

The face plate or base plate of Ruskin U.S. Pat. No. 2,880,264 does not have the shoulder or boarder with cavities as described in the instant invention. Further, the Ruskin patent of necessity depends upon a rib projecting forwardly from one end of the face plate which rib has a pair of oppositely directed stub shafts for mating with apertures formed in the box-like cover. This combination is obviously substantially structurally different from the pins - cavities - shoulder combination of the instant invention.

The Hirsch U.S. Pat. No. 2,916,733 discloses an electrical socket outlet protector comprising a face plate and cover pivotally connected to the face plate. This pivot connection between the face plate and cover is described in Column 2, lines 29–39 and comprises a series of lugs, pintles, and rivets which differs substantially from the mechanism of the instant invention.

The Shotey U.S. Pat. No. 4,874,906 discloses a lid member pivotably and demountably connected to a mounting plate or face plate by means of a lip element having an inwardly turned hook portion which fits over an elongated top flange and into a groove formed in the mounting or face plate "to form a pivotable demountable inter-connection". See Column 3, lines 56–65. This pivotable demountable interconnection obviously differs substantially from the pin and slot connection structure of the instant invention.

The Leong U.S. Pat. No. 4,381,063 teaches a weatherproof cover assembly for electrical wiring devices comprising a housing and a pivotally attached cover. A hinge between the cover and housing is shown in FIG. 5 and described in Column 4, lines 40–66 and is obviously of a much more complicated structure than the pin and groove assembly of the instant invention and includes at least a cylindrical opening, a post and slot, a torsion spring with end loops, a pivot insert including a base portion and post having a slot etc.

The U.S. Pat. No. to Bowden, Jr. et al. 4,505,403 also discloses a weatherproof cover for an electrical receptacle comprising a base plate and lid cover.

In this invention, and as best seen in FIG. 9, and described in Column 3, lines 3–8, lids are snapped into a coverplate and are retained by j-shaped slots cooperating with bosses carried by the lids. In addition, a butterfly spring is used to exert a force upon the lids to keep them held in close proximity to the cover plate.

SUMMARY OF THE INVENTION

According to the present invention a face plate having one or more openings therethrough for receiving a standard electrical plug is attached by any well known means, such as a screw or other fastening device, to a wall mounted electrical plug receptacle. The face plate has a raised shoulder on all four edges generally perpendicular to a planar surface which is attached to the wall. A flange receiving recess is formed between the planar surface and the raised shoulder at the bottom edge of the face plate for receiving a flange for securing a box-like cover to the face plate as will be more particularly described below. Further, tabs are formed integrally with the upper ends of the vertical shoulders and pin receiving apertures are formed through the tabs and adjacent shoulders for slidably receiving pins formed integrally with a flange formed on the upper end of the box-like cover for further securing it to the face plate. Vertical slots are formed in each tab which extend downwardly and intersect the pin receiving apertures whereby the pins of the box-like structure are slidably received and then extended through the apertures.

Formed integrally with the face plate, at its upper end, and at about its mid-point, and extending downwardly, is a cam surface which cooperates with the flange formed on the upper end of the box-like structure for securing the cover in the open position when it is rotated upwardly from its closed position about the pins.

Electrical cord receiving openings are formed in the lower end of the box-like cover which provides flexibility to the lower end of the box-like structure and through which electrical cords pass when an electrical appliance is plugged into the electrical outlet and the cover is pressed over the face plate.

To further provided flexibility to both the upper and lower ends of the box-like cover and to provide recesses for receiving the vertical shoulders of the face plate when the cover is positioned over the face plate, slots are formed at all four corners of the box-like cover adjacent its open end.

It is therefore an object of the present invention to provide a protective cover for an electrical wall outlet.

It is another object of the invention to provide an improved protective cover for an electrical wall outlet having a protective cover engaging a face plate which in turn is mounted on an electrical plug receptacle.

It is a further object of the invention to provide an improved protective cover for an electrical wall outlet wherein the protective cover is hingeably connected to the face plate by means of pins formed integrally with the cover engaging apertures formed through shoulders formed integrally with the face plate.

It is yet another object of the invention to provide an improved protective cover for an electrical wall outlet wherein the protective cover member is a generally rectangular box-like structure having one open end for engaging the face plate and wherein the box-like structure has a flange at one end, adjacent the open end, for engaging a recess formed in the lower shoulder of the face plate, adjacent its planar surface, for securing the cover to the face plate.

These and other objects, features and advantages of the invention shall become apparent from the following detailed description of a preferred embodiment thereof when taken in conjunction with the drawings wherein like reference characters refer to corresponding parts in the several views.

DETAILED DESCRIPTION OF THE PREFERRED EMBODIMENT

An electrical wall plug outlet enclosure and safety device according to a preferred embodiment of the invention will now be described with initial reference to FIGS. 1–7 of the drawings.

Figure 1:
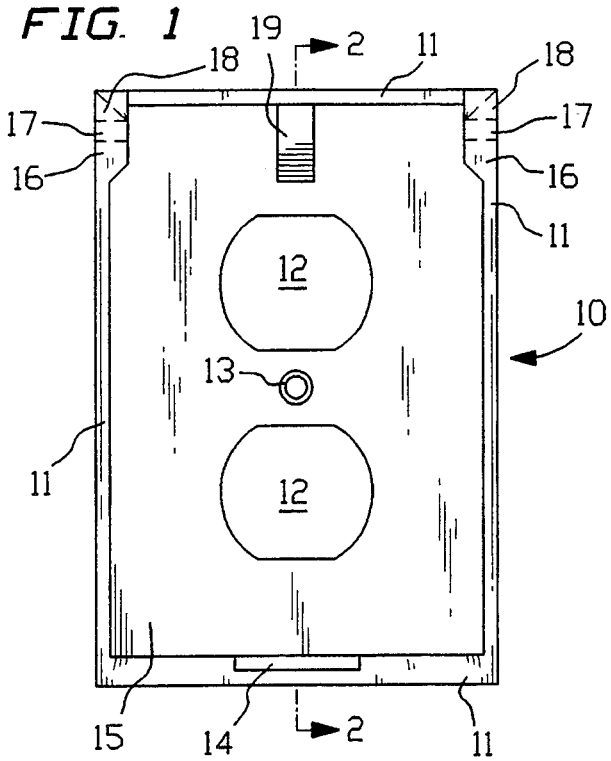
FIG. 1 is a front view of the face plate of the invention showing the raised shoulder, bottom recess, cam surface, openings for receiving an electrical plug and an opening for receiving a fastener for attaching the face plate to an electrical wall plug receptacle not shown.
Figure 2:
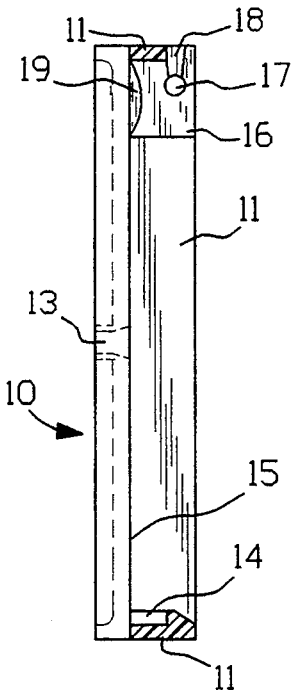
FIG. 2 is a sectional view taken on line 2—2 of FIG. 1.

A face plate 10 having a raised shoulder 11 on all four edges is shown particularly in FIG. 1. Electrical plug receiving openings 12 are formed through face plate 10 for receiving an electrical plug not shown. An electrical cord is attached at one end to the electrical plug and at its other end to an electrical appliance also not shown. A fastener 13, such as a screw, is located at the approximate mid-point of face plate 10 for securing it to the electrical wall plug outlet.

A flange receiving recess 14 is formed in the raised shoulder 11 adjacent a planar surface 15 of face plate 10 at the lower edge of the face plate for purposes to be more fully described below.

Tabs 16 are formed integrally on the inside of each of the two vertical shoulders near the top of the face plate and adjacent to the planar surface 15 and apertures 17 are formed through each of said tabs and through the adjacent shoulders from purposes to be more fully described below. Vertical slots 18 are formed in each tab extending downwardly from the top of the vertically extending shoulders and intersect the apertures 17.

Formed integrally with the planar surface 15 of face plate 10, at its upper end, and at about its mid-point, and extending downwardly therefrom, is a cam surface 19 which cooperates with a flange as will also be more fully described below.

Figure 3:
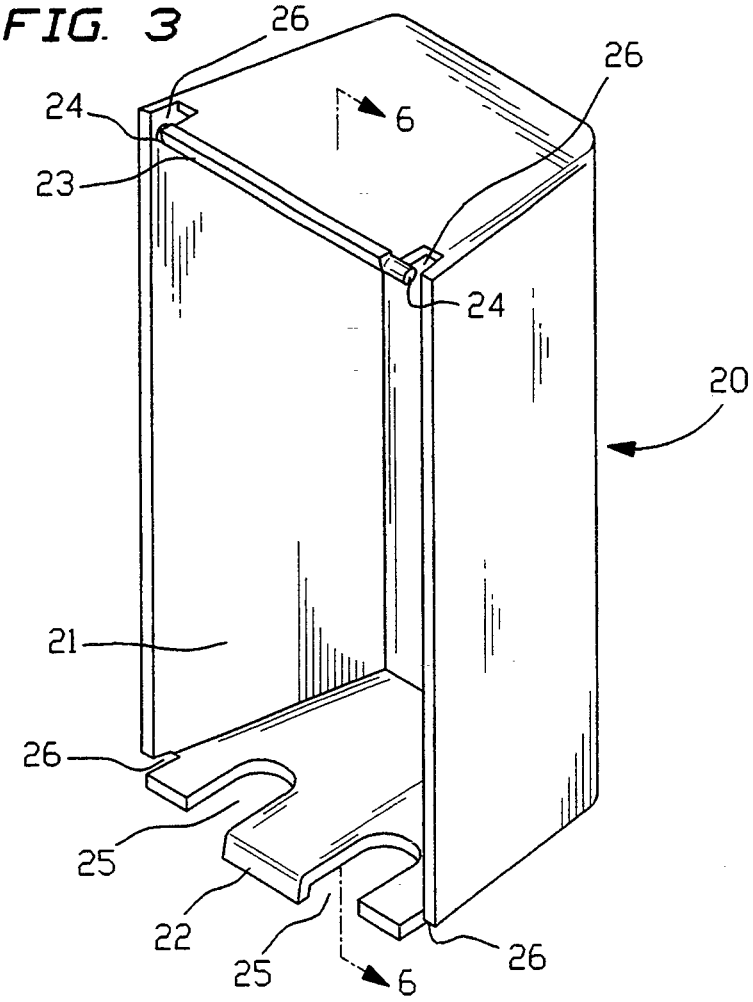
FIG. 3 is a pictorial view of the protective cover of the invention.
Figure 4:
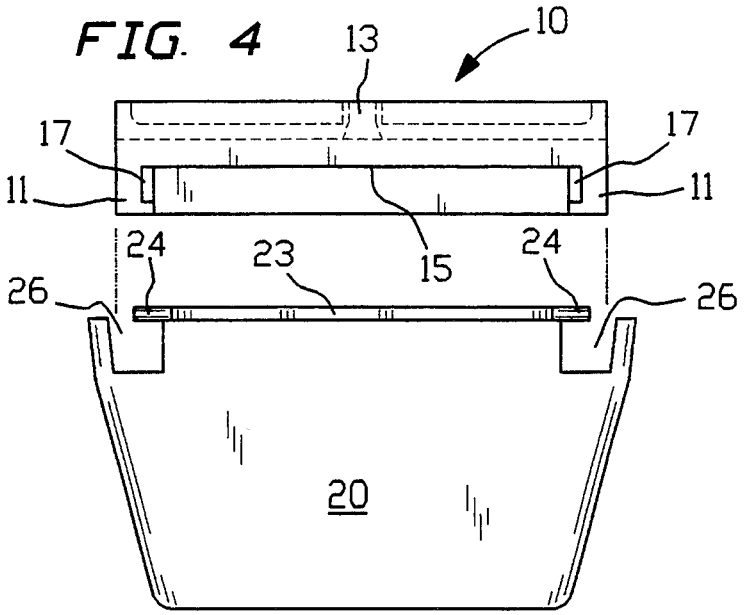
FIG. 4 is an exploded end view showing the face plate in the upper portion and the protective cover in the lower portion.
Figure 5:
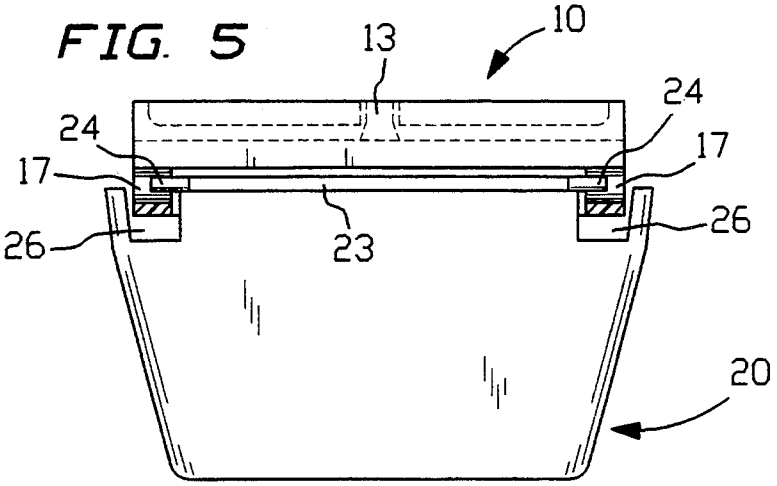
FIG. 5 is a view similar to FIG. 4 but showing the face plate and cover in locking engagement.

Referring now particularly to FIG. 3 there is shown a box-like cover 20 having an open end 21 for engaging said face plate 10 and a first flange 22 formed on its lower end adjacent said open end 21 for engaging said flange receiving recess 14 formed in the raised shoulder 11 for securing the box-like cover 20 to the face plate 10 when the box-like cover is placed over the face plate.

A second flange 23 is formed on the other end of said box-like structure, adjacent said open end, and opposite the end having the first flange, and having one pin 24 extending horizontally from each end thereof for engaging apertures 17 of tabs 16 and shoulders 11 when the box-like cover 20 is placed over the face plate 10. This second flange 23 cooperates with the cam surface 19 of face plate 10 when the box-like cover 20 is pivoted about pins 24 to the position shown in FIG. 6 to keep the box-like cover in the open position.

A plurality of electrical cord receiving openings are formed in one end of the box-like cover 20 adjacent said first flange 22 which allow for passage of electrical cords and which further lend flexibility to the lower end of the box-like cover.

Slots 26 are formed at each of the four corners of said box-like cover 20, adjacent its open end, for receiving the vertical shoulders 11 of face plate 10 when the box-like cover is positioned over the face plate, the first flange 22 is engaging the flange receiving recess 14, and the box-like cover 20 is pivotably mounted to face plate 10.

In operation, the pins associated with the second flange of the box-like cover are slid downwardly through the vertical slots formed at the top of the tabs and shoulders until they cooperate with and extend through the apertures formed through the tabs and adjacent shoulders. The box-like cover is then rotated or pivoted downwardly and the first flange is pressed into the flange receiving recess formed in the bottom shoulder of the face plate.

Figure 6:
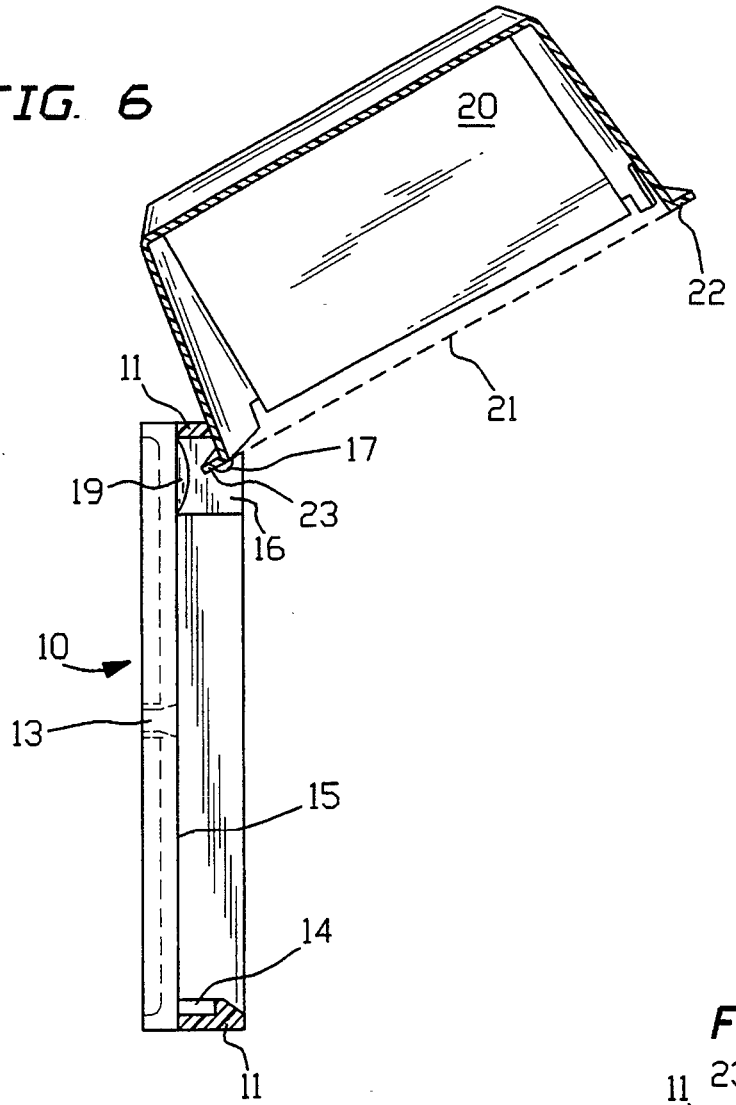
FIG. 6 is a view of the face plate as in FIG. 2 and a sectional of the cover taken on line 6—6 of FIG. 3.
Figure 7:
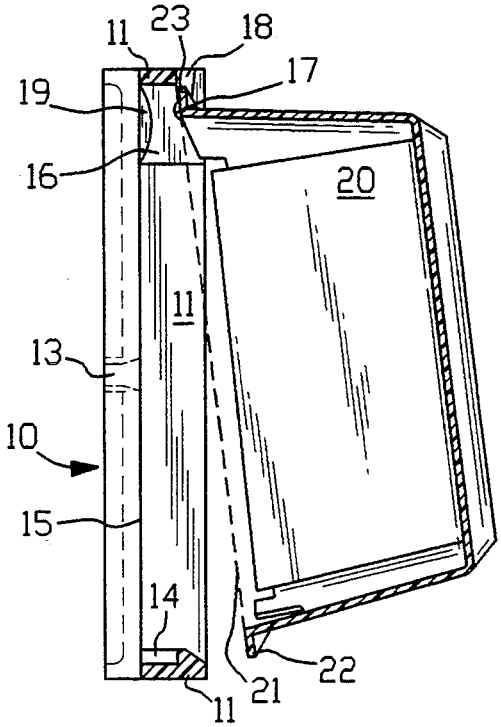
FIG. 7 is similar to FIG. 6 but showing the cover rotated downwardly to its nearly closed position.

To disengage the box-like cover upward pressure is applied to the first flange at the bottom outside of the box-like cover until the first flange becomes disengaged from the flange receiving recess and the cover is rotated or pivoted about the pins to the position shown in FIG. 6 where it is held open by means of the second flange resting on the cam surface.

Though the invention has been described and illustrated with reference to a preferred embodiment thereof, those skilled in the art will appreciate that various changes and modifications in shape, size, composition and arrangements of parts may be resorted to without departing from the spirit of the invention or scope of the subjoined claims.

What is claimed is:

1. An electrical wall plug outlet enclosure and safety device comprising:

(a) a face plate having at least one electrical plug-receiving opening detachably mounted to an electrical wall plug outlet, for detachably receiving a box-like cover;

(b) a raised shoulder formed integrally on the four edges of said face plate generally perpendicular with a planar surface of said face plate;

(c) a flange-receiving recess formed in said raised shoulder adjacent said planar surface at the lower edge of said face plate;

(d) a tab formed integrally on the inside of each of two vertical shoulders of said face plate at the upper ends thereof;

(e) an aperture formed through each of said tabs and adjacent shoulder;

(f) said box-like cover being of generally rectangular shape and having one open end for engaging said face plate;

(g) a first flange formed on one end of said box-like cover adjacent said open end for engaging said flange receiving recess for securing said box-like cover to said face plate; and (h) a second flange formed on one end of said box-like cover, adjacent said open end, and opposite the end having said first flange, said second flange having one pin extending horizontally from each end for engaging said apertures whereby said box-like cover is pivotably mounted to said face plate.

2. A device as claimed in claim 1, wherein a cam surface is formed on said face plate, at its upper end, at about its mid-point, which cooperates with said second flange for securing said box-like cover in an open position when it is rotated upwardly about said pins.

3. A device as claimed in claim 2 wherein a vertical slot is formed in each of said tabs extending downwardly from the top of each of said vertical shoulders and intersecting said apertures whereby said pins are slidably received and extended through each of said apertures for pivotably mounting said box-like cover to said face plate.

4. A device as claimed in claim 3 wherein a plurality of electrical cord-receiving openings are formed in one end of said box-like cover adjacent said first flange and which provide flexibility to the lower end of said box-like cover.

5. A device as claimed in claim 4 wherein a slot is formed at each of the four corners of said box-like cover, adjacent its open end, which slots receive said vertical shoulders of said face plate when said box-like cover is positioned over said face plate, said first flange is engaging said flange receiving recess and said box-like cover is pivotably mounted to said face plate.

* * * * *